United States Patent [19]

Saxby

[11] Patent Number: 4,539,969

[45] Date of Patent: Sep. 10, 1985

[54] CARTRIDGE ASSEMBLY INCLUDING PRESSURE CYLINDER SLIDABLY LOCATED IN CASING

[75] Inventor: Michael E. Saxby, Warwickshire, England

[73] Assignee: Hilvenna Limited, Great Britain

[21] Appl. No.: 469,365

[22] Filed: Feb. 24, 1983

[30] Foreign Application Priority Data

Feb. 27, 1982 [GB] United Kingdom ..... 8205875

[51] Int. Cl.[3] ..... F41B 11/06; F42B 9/02

[52] U.S. Cl. ..... 124/57; 102/440; 124/58; 403/342

[58] Field of Search ..... 124/57, 58, 66, 27, 124/28; 102/430, 440, 444; 42/1 L, 69 A; 403/342, 343

[56] References Cited

U.S. PATENT DOCUMENTS

| | | | |
|---|---|---|---|
| 1,517,761 | 12/1924 | Sorensen et al. | 403/342 X |
| 1,893,033 | 1/1933 | Murdock et al. | 403/342 |
| 1,996,422 | 4/1935 | Hurley | 403/342 X |
| 2,327,653 | 8/1943 | Lisle | 124/57 |
| 2,815,231 | 12/1957 | Wilson | 403/342 |
| 3,554,582 | 1/1971 | Yamashita et al. | 403/342 X |
| 4,361,093 | 11/1982 | Saxby | 102/430 X |

FOREIGN PATENT DOCUMENTS

| | | | |
|---|---|---|---|
| 1372175 | 8/1964 | France | 102/430 |
| 149459 | 8/1920 | United Kingdom | 403/342 |
| 858282 | 1/1961 | United Kingdom | 124/66 |
| 1601918 | 11/1981 | United Kingdom | 102/440 |

*Primary Examiner*—Richard T. Stouffer

*Attorney, Agent, or Firm*—Neil F. Markva

[57] ABSTRACT

Air gun apparatus for firing missiles 11 including a gun and a replaceable cartridge assembly. The cartridge assembly includes a casing having a detachable hollow nose, a pressure cylinder slidably located in the casing, and a valve mechanism normally biased by a valve spring in the cylinder to close a gas discharge path from the interior of the cylinder to the hollow nose via a removable hollow valve abutment member. The valve mechanism is openable by forcible movement of the cylinder towards the hollow nose. The gun includes a seating at a breech end of a barrel, a breech, and a breech block assembly. A firing spring acts on an inertia member which is releasable by a trigger mechanism. The breech block assembly includes a thrust member biased in a direction toward the seating by a centering thrust spring for thrusting the cylinder 13 toward the barrel so as to take up clearances with the valve mechanism and to thrust the hollow nose against the seating when the breech block assembly is moved into a firing position. The cartridge is rechargable with compressed air by a pump having a reload mechanism to engage and support the cartridge after removal of the nose and abutment member.

19 Claims, 7 Drawing Figures

CARTRIDGE ASSEMBLY INCLUDING PRESSURE CYLINDER SLIDABLY LOCATED IN CASING

FIELD OF THE INVENTION

This invention concerns improvements in or relating to guns and ammunition for such guns adapted to utilise air or another gas at high pressure to propel missiles.

BACKGROUND OF THE INVENTION

In our British Patent Specifications Nos. 1601917 and 1601918 there is disclosed a form of ammunition which comprises a hollow outer casing, a pressure cylinder within the casing, valve means at one end of the cylinder, a missile located in a mouth at a nose end of the casing, the pressure cylinder being slidable within the casing to cause the valve means to open and permit compressed air, contained in the cylinder, to flow from the cylinder to the mouth of the casing to expel the missile. The ammunition could be recharged with compressed air and a new missile, so as to be readily re-useable.

The ammunition was designed for use in a firearm, with temporary modification of the latter to provide a barrel sleeve and a blunt firing pin, or for use in a similar weapon permanently adapted only to accept such ammunition to enable missiles of air gun pellet form to be employed for qualification as an air gun and not as a firearm under the laws of certain countries.

While such ammunition was effective when initially tested in particular guns under laboratory conditions, further trials revealed many disadvantages some of which could not be overcome by prolonged development of, and engineering modifications to, the ammunition and the guns. (As a result, our alternative form of practice ammunition, decribed in our British Patent Specification No. 2044896A, was developed for production and is now in use). Said disadvantages included wide variations in the accuracy and velocity of missiles fired under identical conditions using apparently identical ammunition, difficulties in recharging and reloading the ammunition, premature discharge risks, and incompatibility of the gun/ammunition combination with the laws of certain countries. Further, said developments and engineering modifications, while overcoming or reducing some disadvantages, would have been excessively expensive if put into production.

What is still needed is, as mentioned in said Specifications Nos. 1601917 and 1601918, means enabling persons to practice shooting, which offers a combination of the advantages of standard air guns with the advantages arising from using cartridge ammunition, without the costs and hazards involved in the use of explosive propellants.

SUMMARY OF THE INVENTION

In general, the present invention provides apparatus, for firing missiles, comprising a gun and a replaceable cartridge assembly, the cartridge assembly including a casing having a hollow nose, a pressure cylinder slidably located in the casing, and valve means normally biased by a valve spring in the cylinder to close a gas discharge path from the interior of the cylinder to the hollow nose, which valve means is openable by forcible movement of the cylinder towards the hollow nose; characterized in that the gun comprises a seating at a breech end of a barrel, a breech, a breech block assembly, a firing spring which acts on an inertia member which is releasable by a trigger mechanism; wherein the breech block assembly includes a thrust member biased in a direction towards the seating by a centering thrust spring for thrusting the cartridge assembly towards the barrel to thrust the hollow nose against the seating when the breech block assembly is moved into a firing position while the cartridge assembly is in the breech.

A missile is preferably connected to or located in the hollow nose, so that the combination of the missile and the cartridge assembly serves as a round of ammunition. The missile may be of any suitable form, but for shooting practice and amateur use it is intended that the missile will be an air gun pellet, as such pellets are readily available at low cost, and the hollow nose is preferably designed to house such a pellet. In relation to the use of such pellets it has been found that the apparatus of the invention reduces many of the disadvantages discovered during the trials hereinbefore mentioned. In particular, the invention offers a reduction of the problems which arose from slight dimensional variations between particular cartridge assemblies, and improves ballistic accuracy.

The thrust member preferably constitutes a blunt firing pin which is slidably carried by a breech block of the breech block assembly, so that the firing pin is movable between predetermined limits relative to the breech block, and the inertia member is arranged to drive the firing pin towards the breech until one of said limits is reached. Thus, in use, the centering thrust spring acts via the firing pin and the cylinder upon the casing to engage the hollow nose with the seating when the breech is closed by the breech block assembly, and this action confers greatly improved performance and enables most of said disadvantages to be avoided at little production cost.

Furthermore, the thrust of the thrust spring upon the cylinder is preferably greater than the thrust of the bias applied by the valve spring upon the valve means, so that after firing the valve means is held open by the thrust of the thrust spring until the breech is opened.

The mass and permitted distance of movement of the inertia member and the thrust of the firing spring are preferably such as to impart to the inertia member, upon release of the latter by the trigger mechanism, kinetic energy which is equated with the energy (impulse) required to open the valve means to allow at least a major proportion of the gas in the cylinder to be discharged when the cylinder is charged to a predetermined pressure, so as to minimize deflection of the gun from a nominal aimed position upon firing. This equating of the kinetic energy with the valve opening energy, gives an additional advantage of preventing the valve being opened if the cylinder pressure is too high, and of restricting the amount of gas discharged if the cylinder pressure is fractionally above the predetermined pressure.

The invention includes the gun per se, and in particular provides a gun for discharging compressed gas powered cartridge assemblies, the gun comprising a seating at a beech end of a barrel, a breech, a breech block assembly, a firing spring which acts on an inertia member which is releasable by a trigger; wherein the breech block assembly includes a thrust member biased in a direction towards the seating by a centering spring for thrusting a cartridge assembly towards the seating when the breech block assembly is moved into a firing position while the cartridge assembly is in the breech;

wherein said thrust member is a firing pin arranged to be actuable by the inertia member.

The inertia member, firing spring and beech block assembly preferably form parts of a bolt assembly, the breech block assembly comprising a breech block fixedly secured to a hollow bolt body to hinder removal of the inertia member and firing spring.

The invention further includes the cartridge assembly per se in which the hollow nose is complementary to the seating of the gun.

However, a few of the aforementioned disadvantages were found to be inherent in the cartridges described in our aforesaid British Patent Specifications, and the aforementioned prolonged development only achieved minor reductions in said few disadvantages.

According to the present invention there is further provided an improved cartridge assembly comprising a casing having a hollow nose, a pressure cylinder slidably located in the casing, and valve means normally biased by a valve spring in the cylinder to close a gas discharge path from the interior of the cylinder to the hollow nose, which valve means is openable by forcible movement of the cylinder towards the hollow nose, characterized in that the gas discharge path is provided by a hollow valve abutment member having a cylindrical portion which extends from a head of the valve abutment member through an end wall of a body of said casing and into a valve end portion of the cylinder to abut a valve member in the cylinder, the head of the valve abutment member being hollow and being releasably clamped between said end wall and a nosepiece of the casing, which nosepiece defines the hollow nose and is releasably secured to the body of the casing.

In this improved cartridge assembly, the cylindrical portion of the valve abutment member and the valve end portion of the cylinder are self aligning about a common axis; and the nosepiece and valve abutment member are removable. This latter feature gives rise to many advantages. For example, in the case wherein the nosepiece defines a mouth for an air gun pellet, the pellet can be loaded into the mouth from the rear of the mouth so that the skirt of the pellet is located between the head of the valve abutment member and the nosepiece, so as to avoid damage to the skirt. However, the main advantage of this improved cartridge assembly arises from the interrelationship between the gun and the cartridge assembly. The concept underlying the improved gun is extended in the improved cartridge to give improved performance which arises because the action of the thrust spring brings the self-aligning capability of the cartridge assembly into effect, thereby minimizing the effects of manufacturing tolerances and other variables which otherwise detract from the performance of the apparatus.

Other disadvantages arose from the difficulty of manually recharging the cylinders with compressed air using a pump, and the present invention also provides improved air pump apparatus comprising a pump cylinder, a piston in said cylinder and movable to abut an outlet end of the cylinder by means of an actuating mechanism for compressing air in the cylinder, characterized in that a cylindrical charging tube projects from said outlet end, in that cartridge support means is provided concentric with said charging tube for supporting a cartridge during charging, in that said actuating mechanism is manually actuable and provides an increasing mechanical advantage as the piston is moved to abut said outlet end; and in that means is provided to limit the maximum pressure to which air can be compressed by the pump.

Said cartridge support preferably comprises a female thread in which a male nosepiece retaining thread on the casing is engageable after removal of the nosepiece and valve abutment member, and preferably further comprises a hollow guide member for aligning the cartridge assembly with the charging tube as the cartridge assembly is inserted into the guide member. This form of support provides accurate location of the cartridge assembly with respect to the charging tube, and protects the latter from impact damage and contamination by dust.

The apparatus for firing missiles may include the improved air pump apparatus.

The improved cartridge assembly permits recharging using the improved pump apparatus by means of a method provided in accordance with the invention, which method comprises the steps of:

(a) removing the nosepiece and valve abutment member from the cartridge assembly, (b) locating the remainder of the cartridge assembly in the pump apparatus so that the cylindrical charging tube of the apparatus extends from the outlet end of the pump cylinder of said apparatus and engages in said valve end portion, (c) actuating the piston in said pump cylinder to drive air into said tube and cause said valve means to open to admit said air into the cylinder, and (d) continuing said actuation until the piston abuts said outlet end to reduce the volume between the piston and the valve means to substantially the volume within the tube.

Said tube is preferably provided with peripheral sealing means to engage said in valve end portion.

The invention includes the combination of the improved cartridge assembly and said pump apparatus.

Furthermore, the improved cartridge assembly has the advantage that it can be constructed so that many of the parts of the assembly are common to a wide range of cartridge assemblies for a range of uses or purposes, e.g. by varying only the nosepiece. To further this advantage, the body of the casing preferably comprises a main plastics body molding incorporating said end wall, together with a plastics end ring bonded, e.g. welded, to the main body molding remote from said end wall to retain the cylinder permanently within the body. The cylinder is preferably made in two parts from lightweight metal such as aluminium alloy, the parts being joined together in a pressure tight manner after insertion of the valve spring and valve member.

The closure plug preferably provides an impact resistant projection which extends into the end ring, and preferably forms part of or is adapted to serve as volume limiting means for restricting the capacity of the cylinder.

The cylinders and/or casings are preferably coded by color or markings to denote cylinder capacity.

The valve means preferably comprises a valve seating provided by or on said valve end portion, a valve member of poppet form movable relative to the seating, and a plastics or elastomeric sealing member carried by the valve member; and said valve means is preferably characterized in that:

(a) the valve member is attached to one end of the valve spring;

(b) the valve seating is tapered and the valve member has a tapered valve face which engages the valve seating to substantially close the valve discharge path from the gas storage space when the valve means is closed; and (c) the sealing member overlies one end of the junction between the valve seating and valve face to seal said junction.

The tapered form of the valve seating and face ensure that, during closing of the valve means, the valve member is guided by the seating so as to become co-axially aligned with the valve seating, so that, (a) the sealing member is effective to provide a pressure tight seal for preventing loss of stored gas pressure; and (b) in the event of the sealing member perishing or otherwise failing to provide a seal, the valve member severely restricts the rate of pressure loss, thus preventing accidental discharge of the missile, because a slow leakage can escape past the valve abutment member and around the cylinder via a vent path which is functionally equivalent to the vent paths described in our British Patent Specification No. 1601918.

The valve face and seating are preferably polished to taper at identical angles, and are preferably defined by metal, ceramics or hard heat resistant plastics surfaces.

BRIEF DESCRIPTION OF DRAWINGS

The present invention will be described further, by way of example, with reference to the accompanying diagrammatic drawings, wherein.

DETAILED DESCRIPTION

Figure 1:
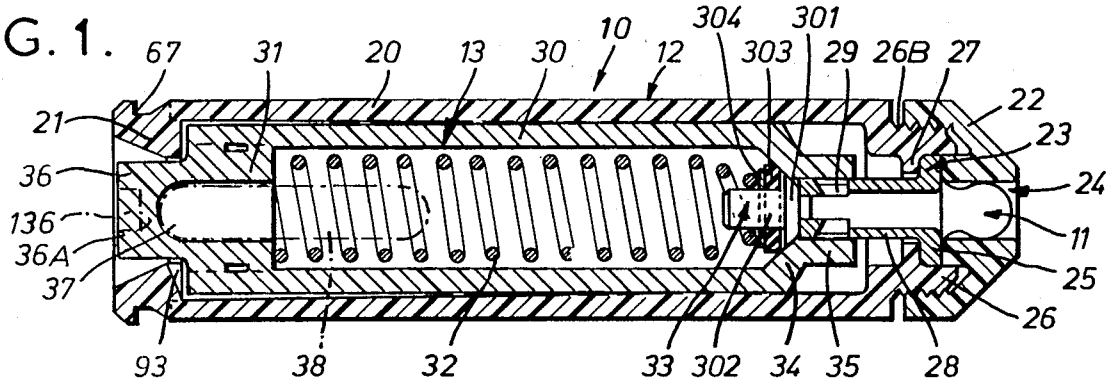
FIG. 1 shows, in longitudinal cross section, a cartridge assembly of the invention in a charged condition.

There are shown in the drawings a cartridge assembly 10 and a gun 14, which in combination constitute apparatus for firing missiles, and a pump 18 which together with said apparatus and missiles constitutes a weapons system.

In this embodiment, the missiles are air gun pellets 11 which are loaded into the cartridge assemblies 10 to form rounds of ammunition, one of which rounds is shown in FIG. 1.

The cartridge assembly 10 comprises a casing 12 and a lightweight metal pressure cylinder 13, which incorporate valve means. The casing 12 comprises a hollow plastics main body molding 20 and an end ring 21 permanently bonded to a base end of the molding 20 to constitute a body 20, 21 of the casing; and comprises a detachable hollow molded plastic nosepiece 22 and a hollow metal valve abutment member 23 (which member 23 constitutes part of the valve means). The nosepiece 22 defines a mouth 24 in which the pellet 11 is located so that a skirt of the pellet 11 is located between the nosepiece and a flange head 25 of the abutment member 23; and the nosepiece 22 is screw threaded to engage an externally threaded end portion 26 of the molding 20 so as to clamp the head 25 against an annular internal end wall 27 of said portion 26. The abutment member 23 includes a cylindrical portion 28 which extends through a central orifice in said end wall 27 into the interior of the body 20,21 and is apertured to provide ports 29 remote from the head 25.

The pressure cylinder 13 is permanently retained in the body 20,21 by the end ring 21, and comprises a hollow main pressure member 30 having a metal closure plug 31 permanently bonded into a base end of the member 30 after a valve spring 32 and valve assembly of the valve means have been inserted into the member 30. The other end of the member 30 provides a wall 34 which provides a conical valve seating 341 (FIG. 2), and a cylindrical extension 35 into which the cylindrical portion 28 extends. Alternatively, the base end of the member 30 may incorporate the closure 31; while the other end is separately made and secured to the member 30 to provide the extension 35. The valve assembly comprises a valve member 33 having a tapered valve face 301 and a stem 302, an elastomeric seal 303 around the stem 302 and a backing washer 303 which is engaged by the spring 32. The stem 302 is pushed into one end of the spring 32 to connect the latter and the valve assembly. In the closed position of the valve means, as shown in FIG. 1, the face 301 abuts and substantially sealingly engages part of the seating 341 to provide a surface to surface junction therebetween. The seal 304 abuts the part of the seating around the head so as to engage one end of the junction to seal the latter.

At the high gas pressures, e.g. 1.4 or more kilograms per square millimeter (2000 or more pounds per square inch), employed, the gas pressure tends to deform the sealing member but the intimate surface to surface contact at the junction serves to prevent the sealing member 303 being extruded through said junction.

The plug 31 has an impact resistant base 36 which extends into the ring 21, and has a recess 37 which serves as or as part of capacity limiting means. The recess may be used as a socket to receive a body, e.g. as indicated in broken lines at 38, to reduce the effective internal volume of the cylinder.

In use, the cylinder 13 is charged with compressed air to a pressure within a predetermined range.

The gun 14 (FIG. 3) comprises a stock (not shown) to which is fitted a main tube 40 provided at one end with a trigger mechanism 41 and at the other end with a breech member 42 in which a rear end portion of a barrel 43 is secured so as to provide a conical seating 44 at one end of the breech chamber 45. The tube 40 houses a bolt assembly which comprises a hollow bolt 46, an inertia member 47 slidably located in the bolt so that a stepped rear end portion 48 extends from the rear of the bolt for engagement by the trigger mechanism, a firing spring 49 located around the inertia member 47 within the bolt, and a breech block assembly 50 fixedly secured at the front of the bolt 46 to retain the member 47 and spring 49 in the bolt. The assembly 50 comprises a breech block 51, a toothed extractor 52 biased towards the bolt axis by an extractor spring 53, a firing pin 54 biased towards the breech by a thrust spring 55 located in the breech block. The firing pin 54 has a rear head 56 outside the rear of the breech block 51 and a front head 57 which is screwed onto the firing pin 54 so as to compress the thrust spring 55 so that the rear head 56 normally abuts the rear of the breech block 51.

The main tube 40 is slotted to provide an ejection opening 60 and a side slot 61 through which a bolt actuating handle 62 extends in known manner.

Figure 3:
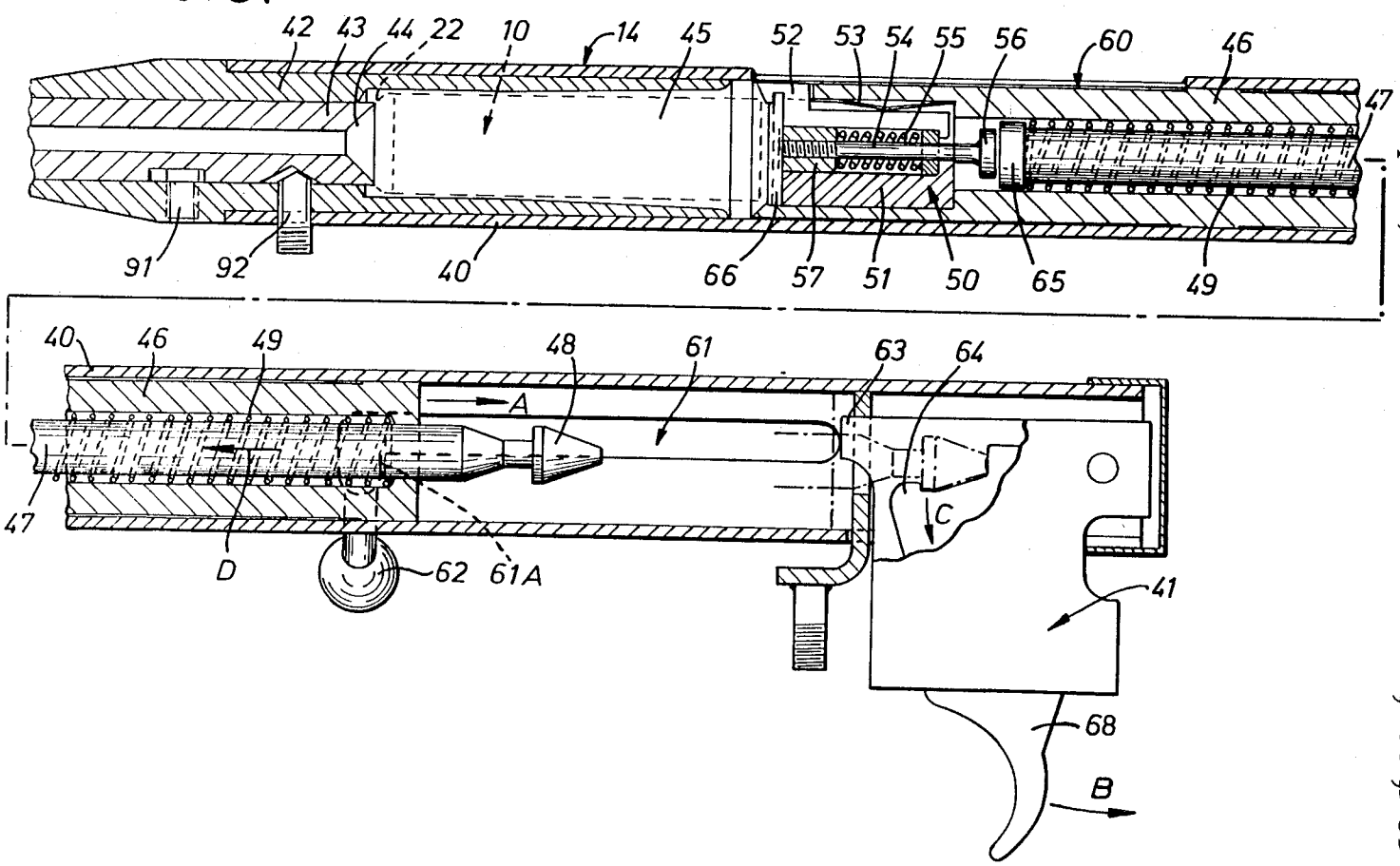
FIG. 3 shows a gun of the invention in partial longitudinal cross-section, loaded with the cartridge assembly shown in FIG. 1.

In use the bolt actuating handle 62 is raised to clear a known form of stop 61A at the front of the side slot 61 and is retracted along the slot 61 to move the bolt rearwards as indicated by arrow A until the rear of the bolt 46 hits a stop 63 on the trigger mechanism and until the stepped portion 48 of the inertia member 47 engages and is held by a sear 64 of the trigger mechanism 41. The retraction of the bolt 46 clears the opening 60 to allow the cartridge assembly 10 to be partially inserted nose first into the open breech chamber 45. The handle 62 is then thrust forwards and re-engaged with the stop to move the bolt, breech block assembly and cartridge assembly to the condition in which they are shown in FIGS. 1 and 3 while causing the firing spring 49 to be compressed between a head 65 of the inertia member 47 (which is still held by the sear 64) and the rear of the bolt 46. During this forward movement the head 57 of the firing pin 54 engages the base 36 of the plug 31 and thrusts the cylinder 13 forwards until, as shown in FIG. 1, the valve member 33 abuts and engages in the end of the portion 28 of the abutment member 22 and thrusts the cartridge assembly forwards until the nosepiece 22 is seated in the seating 44; and thereafter during the last part of the forward movement the base end of the cartridge assembly enters into a socket 66 in the front of the breech block so as to cause the extractor 52 to engage in an extraction groove 67 in the end ring 21, and so as to push the firing pin 54 back relative to the breech block so that the rear head 56 is moved clear of the rear of the breech block.

Figure 2:
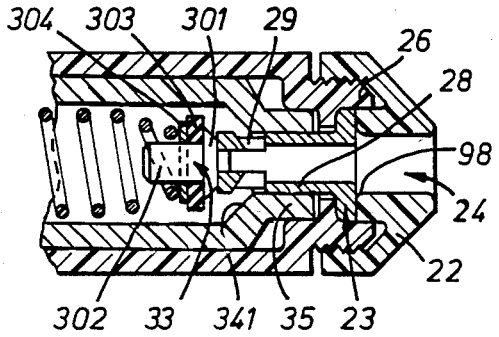
FIG. 2 shows a detail of the cartridge assembly in a discharging condition.

Thereafter, when the trigger 68 of the trigger mechanism is pulled in the direction of arrow B the sear 64 moves in the direction of arrow C to release the inertia member 47 which is propelled forwards (arrow D) to strike the firing pin 54 thereby causing the latter to move the cylinder 13 forwards relative to the valve member and abutment member to the condition shown in FIG. 2 so as to permit the compressed air to discharge from the cylinder 13 into the mouth via the abutment member and thus propel the missile 11 through the barrel. During discharge, the ports 29 and the interior of the abutment member 23 provide a discharge passage for the air from the interior of the cylinder to the mouth.

The sequence is then repeated to reload and fire the gun, but during the rearwards movement of the bolt, the discharged cartridge assembly is drawn to the ejection opening 60 by the extractor 52; and the thrusts of the valve and thrust springs 32 and 55, or one of said thrusts depending upon various factors, tends to pivot the cartridge assembly upwards about a fulcrum provided by the extractor so that, when the nosepiece 22 clears the breech, the cartridge assembly is swung upwards through the opening 60 and in so doing disengages the end ring from the breech block assembly.

Figure 5:
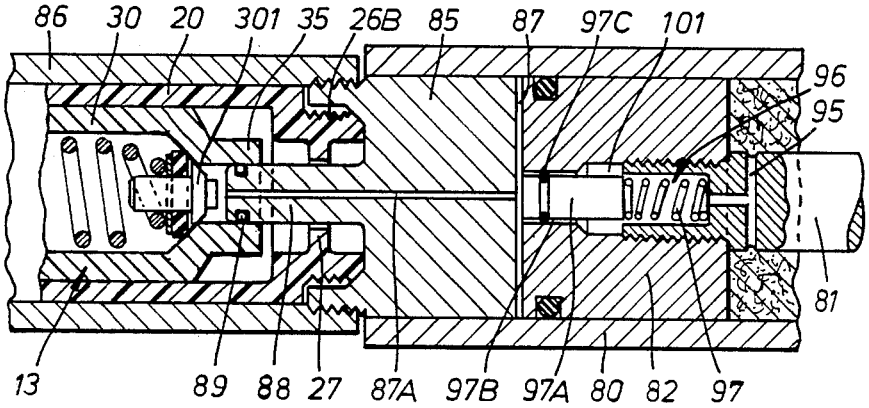
FIG. 5 shows a detail of the pump of the invention in combination with a detail of the cartridge assembly.
Figure 4:
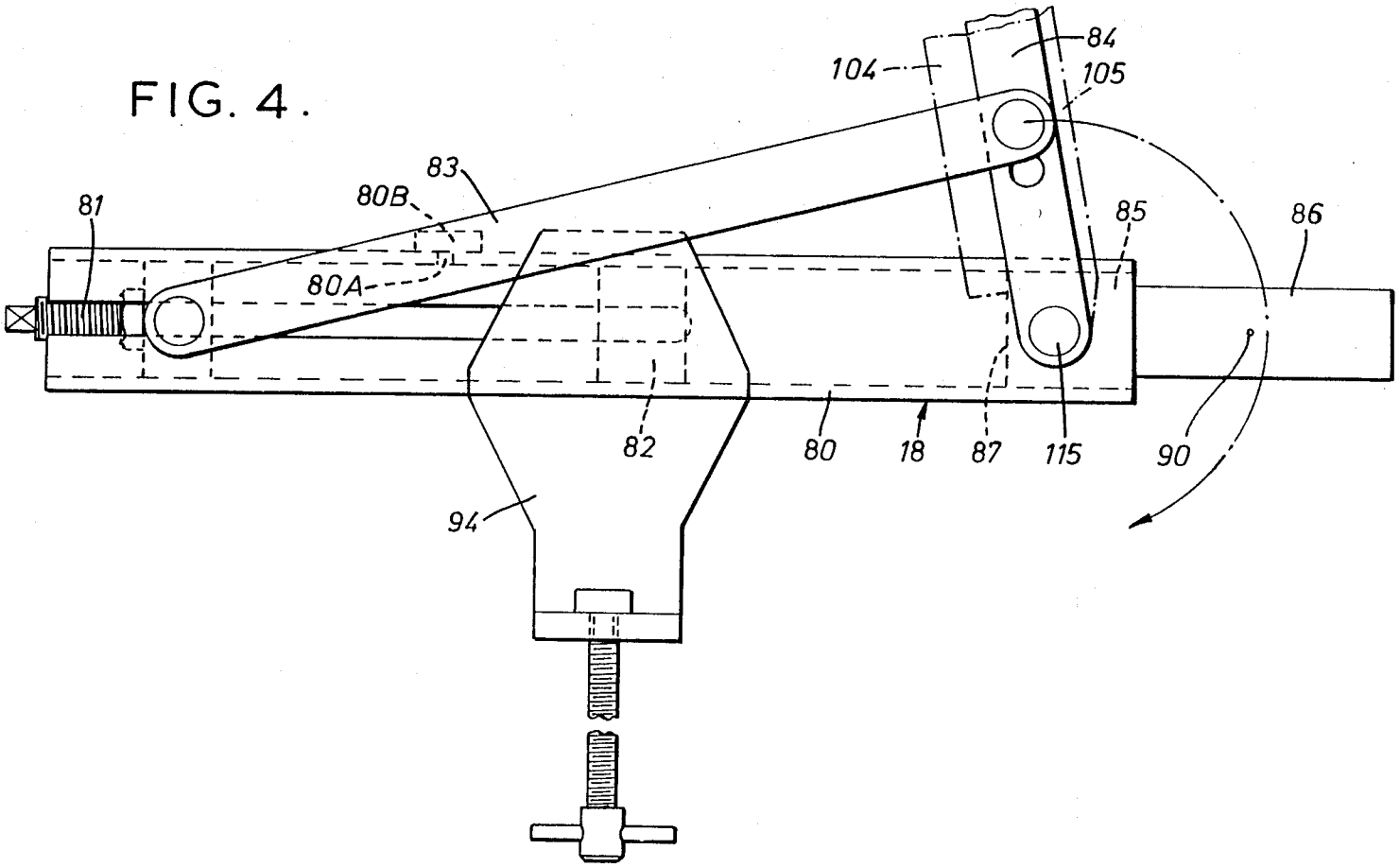
FIG. 4 shows a pump of the invention.

The pump 18, FIGS. 4 and 5, comprises a pump cylinder 80, a piston assembly 81 including a piston head 82 slidable in the cylinder, a drive link 83 pivotally connected between the assembly 81 and a lever 84 pivotally mounted on the cylinder 80, an end member 85 in one end of the cylinder 80 and a holder 86 releasably connected to the end member 85. The cylinder 80, link 83 and lever 84 form a mechanism which is arranged so that the mechanical advantage afforded upon the lever 84 being swung increases as the head 82 is moved in the cylinder towards that face 87 of the end member 85 which confronts the head 82 to reach a maximum when the link 83 is parallel with the axis of the cylinder 80; and said mechanism is arranged so that at the point of maximum advantage the head is in face to face contact with the said face 87 so that substantially all the air compressed by the piston is forced into a narrow bore charging passage 87A in the end member 85. The end member 85 has a charging tube 88, through which said passage 87A extends, which tube 88 is provided with an "O"-ring seal 89 and is dimensioned to enter the cylindrical extension 35 of the pressure cylinder 13 when the nosepiece 22 and abutment member 23 are removed from the cartridge assembly, so that the seal 89 is effective therebetween, as shown in FIG. 5. The holder 86 is screwed onto the end member 85 so as to hold the cartridge assembly against the end member, and is provided with a vent 90.

The pump has a mounting clamp 94 secured to the cylinder 80, and the latter has an air inlet port 80A and an external filter 80B. In the piston assembly 81 there is a pressure relief passage 95 leading to pressure relief valve means 96. The latter comprises a powerful spring 97 acting on a piston valve member 97A which is located in a double diameter bore 97B and carries a sealing ring 97C. The holder 86 is covered during charging by an arched cover 104 pivotally mounted on the pump so as to be swung down by the lever 84 to engage and grip the holder 86 during the first stroke, so that the cover has to be raised manually after pumping to expose the holder for removal of the cartridge. The margins of the cover have longitudinal flanges 105 to abut the lever 84, and the cover prevents the lever 84 being swung down more than a few degrees beyond the horizontal.

Figure 6:
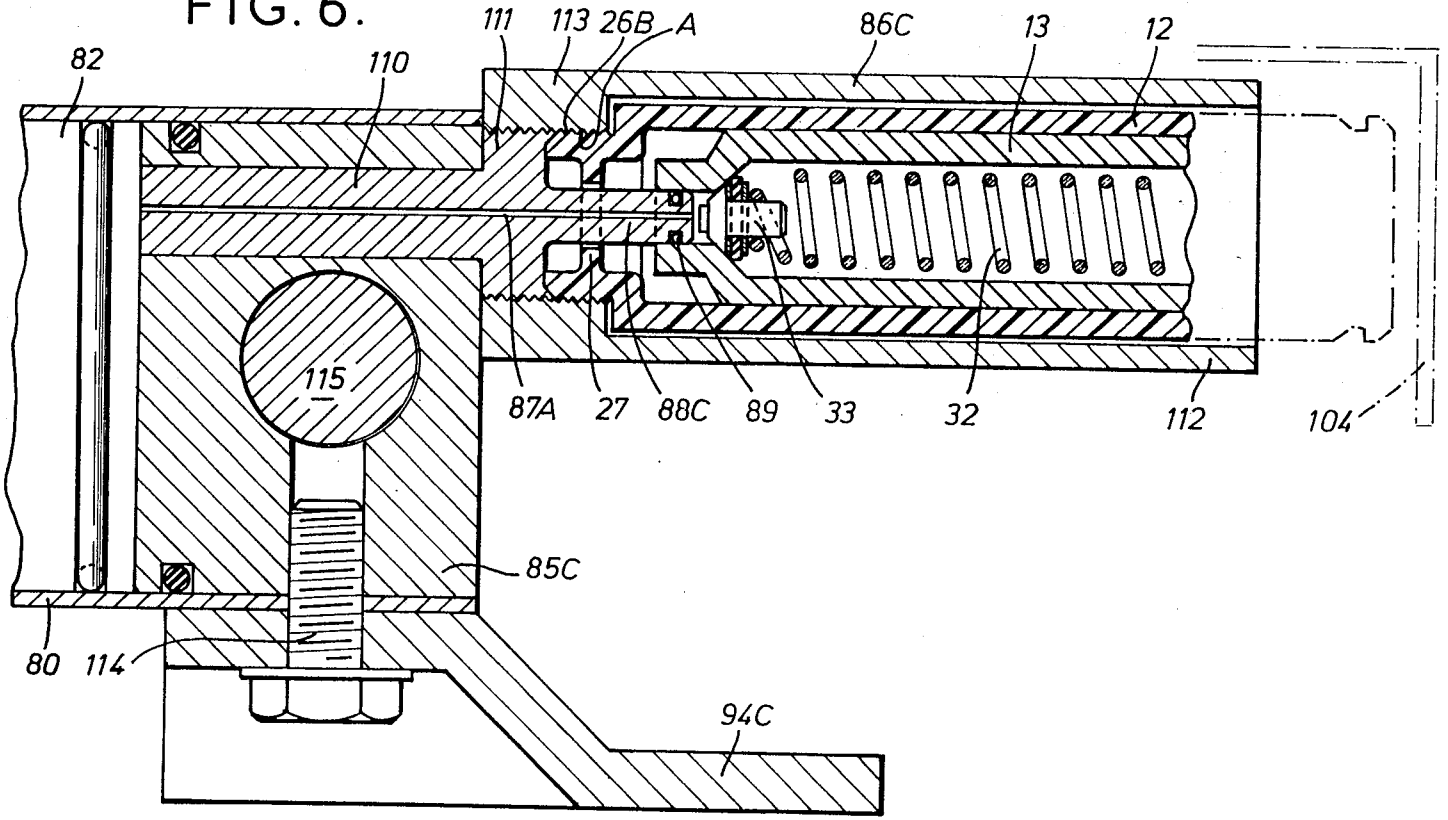
FIG. 6 shows a detail modification of the pump.

FIG. 6 shows an improved pump and those parts of the pump which are identical with the same parts in the pump shown in FIGS. 4 and 5 are identified by the same reference numerals and will not be described further herein whereas modified parts are indicated by the same reference numerals with the addition of the suffix C.

The improved pump differs from the pump shown in FIG. 4 primarily in that:

(a) the charging tube 88C forms part of a member 110 which is releasably or permanently secured to the end member 85C of the pump, and has an externally threaded collar portion 111 which engages the outside face of the end member 85C; and (b) the holder 86C has an open end portion 112 remote from an internally threaded end portion 113 of reduced diameter, which portion 113 engages the portion 111 so as to support the holder 86C in a predetermined relationship relative to the member 110 and so as to leave exposed a part A of the internal thread of the portion 113.

In use, after removal of the nosepiece 22 and valve abutment member 23, the cartridge assembly is inserted into the holder 86C via the portion 112, the holder being dimensioned internally to serve as a guide effective to substantially align the assembly with the charging tube so that the latter passes cleanly through the central orifice clear of the wall 27; and thereafter the casing 12 is rotated to engage the nosepiece retaining thread 26B in the thread part A to retain the cartridge assembly in position for charging.

The improved pump also employs the cover 104 dimensioned to cover the exposed portion of the cartridge assembly (indicated in broken lines in FIG. 6), and embodies other improvements, e.g. the end member 85C (FIG. 6) has an "O"-ring seal and is engaged by a mounting bolt 114 as well as by the pivot 115 on which the lever 85 (FIG. 4) is mounted.

The improved pump is less expensive to manufacture, is easier to use, and is less easily damaged and contaminated than the pump disclosed in FIGS. 4 and 5.

In use, the volumetric capacity of the charging passage 87A is much smaller than the capacity of the pump cylinder and the capacity of the pressure cylinder, so that most of the air compressed by the pump is forced into the pressure cylinder, the valve means 33 acting as a non-return valve for the pump and cartridge combination.

In both embodiments of the pump, the pressure relief valve means 96 serves to limit pump pressure. The piston area of the pump valve member 97A and the rating of the spring 97 are selected so that the spring 97 yields allowing the piston valve member 97A to move back into the piston 82 when said predetermined pressure is reached, thereby initially increasing the effective headspace for the compressed air without allowing compressed air to escape via the passage 95, so as to give time for the compressed air, at said predetermined pressure to traverse the passage 87A and enter the cylinder 30. However, if pumping is continued to fractionally exceed said predetermined pressure, the spring 97 is further compressed allowing a piston seal ring 97C on the member 97A to enter a wider part 101 of the bore 97B allowing compressed air to escape to the passage 95.

The cartridge assembly, the gun and the pump have many inherent individual advantages, and the interrelationship therebetween affords further advantages in addition to those mentioned hereinbefore.

For example, an improved cartridge assembly casing in accordance with a further aspect of the invention can be made substantially from injection molded high strength plastics components (except possibly for the valve spring, abutment member, cylinder and valve member) so that a single elongate one of said components serves as a datum for the cylindrical extension 35 of the cylinder 13 into which the abutment member 23 extends, and wholly incorporates a wall 27 which serves as positional datum and serves as a stop and guide for said cylindrical extension 35 and for the abutment member 23, and therefore in the region of the valve, all critical tolerances are determined primarily by the injection molding of this individual component, e.g. the body molding 20; the other plastics components necessary to form the casing body, e.g. the end ring 21 and the nosepiece, being secured e.g. ultrasonically or frictionally welded, or screwed to the ends of the individual component 20 remote from or outside said valve region so that the small tolerance variations do not significantly affect said valve region. Furthermore, the abutment member 23 is a clearance fit in a central aperture in said positional datum, e.g. the end wall 27, so that it is self aligning with and in said cylindrical extension 35 of the cylinder body as it is inserted through the central aperture; and the abutment member is clamped to the side of said wall 27 which is remote from the side facing the end portion 35 after said self alignment has taken place. These features give a reliably repeatable valve opening action, and thus enhanced firing performance.

In the cartridge assembly the critical tolerances are within the outer casing, and because the assembly is designed to be positionally located in a breech by means of its base and nose end surfaces, the outer peripheral shape of the casing between its end portions is immaterial (provided that the cartridge is narrow enough to be accepted into the breech). Thus, a range of cartridges can be constructed from standard components of which only the nose pieces, end rings and end plugs need to be varied to suit the breech length and end shapes, and the form of the missile. The missile may be separate from the cartridge assembly for prior insertion into the barrel or breech; may be attached to the nosepiece; or may be accommodated in the nosepiece. Considerable cost savings are thus made possible.

Many of the problems hereinbefore discussed are avoided and considerable cost savings are afforded to the user by the separable form of the abutment member, because it can be easily and cheaply replaced if it becomes clogged, corroded, dirty, damaged or worn, so that the rest of the cartridge assembly can be further used.

The gun can be made in many forms, e.g. as a pistol by using a reflex bolt type inertia member with a part shaped to reach the rear end of the firing pin, or by using a hammer as the inertia member. In the gun 14 described it can be seen that the barrel is replaceable, upon releasing the screws 91 and 92, so that a barrel suited to a different type of missile can be used. The form of breech block assembly 50 described has the advantage that the free axial movement of the cylinder 30 is negated and the cylinder is positioned so that the valve and abutment members 33,29 are in contact prior to firing thus minimizing the movement and energy necessary to open the valve; and has the advantage that the rear head 56 of the firing pin abuts the breech block 51 after firing to protect the cartridge from excessive thrust from the inertia member 47.

The gun and cartridge apparatus for firing missiles has several other major advantages which arise from the interrelationship between the gun and the cartridge assembly in which the various forces are equated to limit the energy imparted to the missile. In the cartridge assemblies described herein and in our aforementioned British Patent Specifications, when charged with air or other compressed gas, the valve means is held closed by closure forces comprising:

(a) the thrust of the valve spring, and (b) the gas pressure.

When the cartridge assembly is loaded into breech, the closure forces are opposed by the static thrust of the thrust spring. During firing the inertia member is accelerated by the firing spring to achieve a specific kinetic energy, and four main possible conditions then arise:

(1) If the gas pressure is greatly excessive, the combined static thrust and kinetic energy will not be sufficient to overcome the closure forces and the valve will stay closed;

(2) If the gas pressure is less than in (1) above but is still excessive and above a predetermined pressure, the closure forces will be overcome momentarily but will restore the valve to the closed condition after permitting only a partial gas discharge, thus restricting the impulse imparted to the missile;

(3) If the gas is at the predetermined pressure, the valve will be opened for a period which enables a predetermined maximum amount of gas to be discharged imparting a predetermined maximum impulse to the missile;

(4) If the gas is below said predetermined pressure, the amount of gas available for discharge will be reduced, and even if this amount is completely discharged the missile impulse will be restricted.

This arrangement gives the advantage that the maximum impulse and thus velocity which can be imparted to the missile is strictly predetermined, and attempts to increase said velocity by overpressurizing the cartridge will be futile.

However, at the manufacturing stage said maximum impulse can be predetermined and varied most easily and inexpensively by any one or more of the following variations:

(a) altering the effective cylinder volume using the plug as capacity restricting means e.g. by using a larger or solid plug or putting a solid body in the plug socket, (b) altering the valve spring thrust (not preferred), (c) altering said static thrust (not preferred, except for modifying the spent cartridge ejection forces), (d) altering the firing spring thrust, (e) altering the stroke of the inertia member, and (f) altering the mass of the inertia member.

This arrangement gives the further advantage that if a graph is plotted of pressure: missile velocity, the velocity curve reaches an almost flat topped peak, so that for a reasonable range of pressures above and below but reasonably close to the predetermined pressure, the missile velocities are substantially constant so that minor variations in charging and discharging of the cylinder are not critical to the shooting performance. Hence for a predetermined weapons system the user need only operate the pump for a set number, e.g. one, two or three, of whole strokes and he need not be aware of or concerned about the actual charging pressure achieved.

The main advantage of this arrangement is that the guns, bolt assemblies and cartridge assemblies can be designed to meet the regulations pertaining in particular countries, and can be stamped, colored or otherwise marked and identified appropriately, at minimum cost to the manufacturer and user; and the weapons system as described is almost impossible to modify for illegal use unless the user has substantial engineering knowledge and engineering facilities to make modified parts. However, the cartridge assemblies and the guns have the additional advantage that further safeguards against illegal use and unauthorized modification can be, and will be, incorporated at no or slight increase in manufacturing cost.

In practice, it is preferred to make the thrust of the thrust spring greater, e.g. two or three times, the thrust of the valve spring, so that the valve is held open after firing to obtain a complete discharge of gas (at pressures up to the predetermined pressure). During extraction of the spent cartridge the valve spring will act to pivot the cartridge out of the ejection opening. While a further increase of the thrust of the thrust spring would reduce the kinetic energy of the inertia member required to actuate the valve, and thus the accelerative forces (which generate recoil actions within the gun), such a further increase could represent a safety hazard. For instance, it is preferred to employ gas pressure of about 1 kilogram per square millimeter (100 atmospheres) or more for charging, but if the valve leaks said pressure could drop to a few atmospheres reducing the aforementioned valve closure forces to the point at which the thrust spring could prematurely fire the missile as the nosepiece touched the breech during loading. However, if the thrust spring is only slightly stronger than the firing spring, the missile impulse will be so small that the missile may lodge in the barrel or fall out of the muzzle of the barrel in a harmless manner, because the pressure loss necessary before inadvertent discharge during loading can occur must be so large that very little pressure remains in the cylinder. It should be noted that, as shown in FIG. 3, the free length of the firing spring is such that when the head of the inertia member abuts the spring in an unstressed (uncompressed) condition the head is just clear of the rearmost position of the rear head of the firing pin, so that the firing spring cannot contribute to the force of the thrust spring if the bolt is moved forwards with the inertia member 48 disengaged from the sear 64.

The arrangement has the further advantage that recoil actions and jerking of the gun upon firing are minimized by equating the forces as described, because, at or near to said predetermined pressure, the opening of the valve absorbs (consumes) the kinetic energy of the inertia member and the firing pin supplements the thrust of the thrust spring in resisting the valve closing forces as the gas is discharging. The recoil forces are thus substantially unidirectional. This substantially avoids the jerking which arises in many known pump action air guns due to directional reversal of the recoil forces.

Figure 1A:
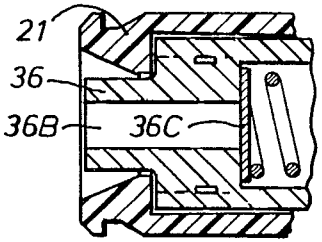
FIG. 1A shows a detail modification thereof.

The above-mentioned features also enable a simple and inexpensive pump to be employed without incorporating into the pump any valves or elaborate safety devices. If the pump is abused to exceed the pressure limits of the cartridge, the end plug 36 is designed to rupture or break away allowing gas to escape, e.g. via a vent channel 93 in the end ring and the vent 90. Also the end plug may have a recess 136 so that a portion 36A serves as a bursting zone which ruptures at above said predetermined pressure. Alternatively, as shown in FIG. 1A the end plug 36 may be hollow to define a blow out duct 36B which is normally closed by a plastics coated or plastics backed metal bursting disc 36C held in place by the spring 36, so that the disc 36C bursts at pressures fractionally above the predetermined pressure.

Various other modifications and variations are possible within the scope of the invention.

For example, the main tube and breech member may have a magazine opening, and a magazine for several cartridges may be provided for the gun, in known manner. For use in certain countries the barrel and breech member may be integral or permanently joined, and the main tube may be permanently jointed thereto.

Also, the external shape of the extension 35 or valve end portion of the cylinder may be varied, as may be the confronting interior surfaces of the casing, e.g. the end wall, but it is preferred to form these shapes so that when the valve is opened a vent path is left to prevent gas being compressed or trapped between said surfaces. In the embodiment described the cylinder is a clearance sliding fit in the casing so that a sufficient clearance space is left open to permit air to escape from adjacent the end of the extension 35 and along the cylinder to the vent channel 93. The vent path is separated from the mouth by a partition constituted by the wall 27 and the head 25, but is connected to the mouth by a slow restricted leakage path via the ports 29.

The forwards loading of air gun pellets enables pellet skirt damage to be minimized during loading, and the pellet is securely and gently retained by reasons of its skirt being trapped by a chamfer 98 on the nosepiece (FIG. 2) and the abutment member, and skirt damage on firing is minimized by the mouth being accurately aligned with the bore of the barrel, which latter bore may be shaped adjacent the breech as described in British Patent Specification No. 2044896A.

I claim:

1. Apparatus for firing missiles comprising:

(a) a gun and a replacable cartridge assembly, (b) the cartridge assembly including a casing having a hollow nose, a pressure cylinder slidably located in the casing, and valve means normally biased by a valve spring in the cylinder to close a gas discharge path from the interior of the cylinder to the hollow nose, (c) the valve means is operable by forcible movement of the cylinder toward the hollow nose, (d) the gun including a seating at a breech end of a barrel, a breech block assembly, a firing spring which acts on an inertia member which is releasable by a trigger mechanism, (e) said breech block assembly including a thrust member and a breech block movable to a firing position retaining the cartridge in said breech in a position wherein the hollow nose contacts said seating, (f) said thrust member biased in a direction toward the seating by a centering thrust spring and movable relative to the breech block under thrust of said centering thrust spring to apply a centering thrust to the cartridge assembly to thrust the hollow nose against the seating, (g) said thrust member directly applies said centering thrust to the cylinder to preload the valve means, (h) said inertia member is mounted to move relative to the thrust member, and (i) the firing spring is arranged to drive the inertia member toward the breech block assembly upon release by the trigger mechanism to apply an additional thrust, larger than said centering thrust, to said cylinder for opening the pre-loaded valve means.

2. Apparatus as defined in claim 1, wherein the thrust member constitutes a blunt firing pin which is slidably carried by the breech block of the breech block assembly, the firing pin is movable between predetermined limits relative to the breech block, and the inertia member is arranged to drive the firing pin toward the breech block until one of said limits is reached to apply said additional thrust to said cylinder.

3. Apparatus as defined in claim 2 wherein the thrust of the thrust spring upon the cylinder is greater than the thrust of the bias applied by the valve spring upon the valve means.

4. Apparatus as defined in claim 1, wherein the mass and permitted distance of movement of the inertia member and the thrust of the firing spring are effective to impart kinetic energy to the inertia member upon release of the latter by the trigger mechanism, said kinetic energy is equated with the energy (impulse) required to open the valve means to allow at least a major proportion of the gas in the cylinder to be discharged when the cylinder is charged to a predetermined pressure.

5. Apparatus as defined in claim 1, wherein the inertia member, firing spring and breech block assembly form parts of a bolt assembly, the breech block of the breech block assembly being fixedly secured to a hollow bolt body, and the free length of the firing spring is restricted in relation to the dimensions of the parts of the bolt assembly to allow the inertia member to move so that it does not contribute to the centering thrust applied to the pressure cylinder.

6. Apparatus as defined in any one of claims 1–5, wherein the breech block assembly includes ejector means for ejecting the cartridge assembly after firing, and the ejector means comprises an extractor which operates in conjunction with said centering thrust spring upon the cartridge assembly to move the latter through an ejection opening in the gun.

7. Apparatus as defined in claim 1, wherein in the cartridge assembly, the gas discharge path includes a hollow valve abutment member having a cylindrical portion which extends from a head of the valve abutment member through an end wall of a body of said casing and into a valve end portion of the cylinder to abut a valve member in the cylinder, the head of the valve abutment member being hollow and being releasably clamped between said end wall and a nosepiece of the casing, the nosepiece defines the hollow nose and is releasably secured to the body of the casing.

8. Apparatus as defined in claim 7, wherein a missile in the form of an air gun pellet is located in the hollow nose so that a skirt of the pellet is located between the head of the valve abutment member and the nosepiece.

9. Apparatus as defined in claim 7 or 8, wherein air pump apparatus comprises a pump cylinder, a piston reciprocably in said cylinder and movable to abut an outlet end of the cylinder by an actuating mechanism for compressing air in the cylinder, a cylindrical charging tube projects from said outlet end, cartridge support means is provided concentric with said charging tube for supporting a cartridge during charging, said actuating mechanism is manually actuable and provides an increasing mechanical advantage as the piston is moved to abut said outlet end means is provided to limit the maximum pressure to which air can be compressed by the pump, and said valve means serves as non-return valve means preventing escape of gas from the cartridge cylinder back to the pump cylinder.

10. A cartridge assembly as defined in the apparatus of claim 1, wherein the cartridge assembly includes a casing having a hollow nose, a pressure cylinder slidably located in the casing, and valve means normally biased by a valve spring in the cylinder to close a gas discharge path from the interior of the cylinder to the hollow nose, the valve means is openable by forcible movement of the cylinder toward the hollow nose, the gas discharge path is defined by a hollow valve abutment member having a cylindrical portion which extends from a head of the valve abutment member through an end wall of a body of said casing and into a valve end portion of the cylinder to abut a valve member in the cylinder, the head of the valve abutment member being hollow and being releasably clamped between said end wall and a nosepiece of the casing, the nosepiece defines the hollow nose and is releasably secured to the body of the casing.

11. A cartridge assembly as defined in claim 10, wherein a missile in the form of an air gun pellet is located in the hollow nose so that a skirt of the pellet is located between the head of the valve abutment member and the nosepiece.

12. A cartridge assembly as defined in claim 10, wherein the body of the casing comprises a main plastics body molding incorporating said end wall, together with a plastics end ring bonded to the main body molding remote from said end wall to retain the cylinder permanently within the body.

13. A cartridge assembly as defined in any one of claims 10, 11 or 12, wherein a valve seating is provided by or on said valve end portion, a valve member of poppet form is movable relative to the seating, and a sealing member is carried by the valve member, the valve member is attached to one end of the valve spring;

the valve seating is tapered and the valve member has a tapered valve face which engages the valve seating to substantially close the valve discharge path from the gas storage space when the valve means is closed, and the sealing member overlies one end of the junction between the valve seating and valve face to seal said junction.

14. A cartridge assembly for use in a gun for firing missiles, said assembly comprising:

(a) a casing having a hollow nose, a nosepiece and an end wall, (b) a pressure cylinder slidably located in the casing, and (c) valve means having a valve member located in a valve end portion of the cylinder, (d) a hollow valve abutment member having a head and a cylindrical portion which extends from the head through the end wall of said casing and into the valve end portion of the cylinder to abut the valve member in the cylinder, (e) the head of the valve abutment member being hollow and being releasably clamped between said end wall and the nosepiece of the casing which nosepiece is releasably secured to the casing.

(f) said valve end portion having a valve seating, (g) said valve member is of poppet form and is movable relative to the valve seating, and (h) a sealing member is carried by the valve member, (i) the valve member is attached to one end of the valve spring, (j) the valve seating is tapered and the valve member has a tapered valve face which engages the valve seating to substantially close the valve discharge path from the gas storage space when the valve means is closed, and (k) the sealing member overlies one end of the junction between the valve seating and valve face to seal said junction.

15. A cartridge assembly comprising:

(a) a casing having a hollow nose, (b) a pressure cylinder slidably located in the casing, and (c) valve means normally biased by a valve spring in the cylinder to close a gas discharge path from the interior of the cylinder to the hollow, (d) the valve means is openable by forcible movement of the cylinder toward the hollow nose, (e) the pressure cylinder including a valve end portion having a valve seating, (f) the valve means including a valve member having a poppet form and being movable relative to the seating, and (g) a sealing member is carried by the valve member, (h) the valve member is attached to one end of the valve spring, (i) the valve seating is tapered and the valve member has a tapered valve face which engages the valve seating to substantially close the valve discharge path from the gas storage space when the valve means is closed, and (j) the sealing member overlies one end of the junction between the valve seating and valve face to seal said junction.

16. A cartridge assembly for use in a gun for firing missiles, said assembly comprising:

(a) an elongate casing having an open base end, a hollow body, front end wall internal with said hollow body, and a nosepiece releasably secured to a front end of said hollow body to provide a hollow nose remote from said base end, (b) a pressure cylinder slidably located in the hollow body and having a valve end portion, (c) valve means being openable by forcible movement of the cylinder toward the hollow nose and having a valve member located in said valve end portion, (d) a removable hollow valve abutment member having a hollow head and a cylindrical portion which extends from the head freely through the front end wall of said casing and into the valve end portion of the cylinder to align with and abut the valve member in the cylinder, (e) the head of the valve abutment member being releasably clamped between one side of said front end wall and the nosepiece of the casing, (f) said front end wall serving as a stop engageable by said valve end portion to limit movement of the cylinder toward the nose.

17. A cartridge assembly as defined in claim 16, wherein the valve means is normally biased by a valve spring in the cylinder to close a gas discharge path from the interior of the cylinder to the hollow nose, the valve means is openable by forcible movement of the cylinder toward the hollow nose, the gas discharge path is defined by the hollow cylindrical portion which extends from the head of valve abutment member through the end wall of a body of said casing and into a valve end portion of the cylinder to abut a valve member in the cylinder, and the nosepiece defines the hollow nose of the casing.

18. A cartridge assembly as defined in claim 16, wherein a missile in the form of an air gun pellet is located in the hollow nose so that a skirt of the pellet is located between the head of the valve abutment member and the nosepiece.

19. A cartridge assembly as defined in claim 16, wherein the casing includes main plastic body molding incorporating said end wall together with a plastics end ring bonded to the main body molding remote from said end wall to retain the cylinder permanently within the body.

* * * * *